US005255729A

United States Patent [19]

Cook

[11] Patent Number: 5,255,729

[45] Date of Patent: Oct. 26, 1993

[54] MATCHED CTE CASTING FOR METAL MATRIX COMPOSITES

[76] Inventor: Arnold J. Cook, 372 N. Craig St., Pittsburgh, Pa. 15213

[21] Appl. No.: 795,105

[22] Filed: Nov. 20, 1991

[51] Int. Cl.[5] ..... B22D 19/14; B22D 19/02

[52] U.S. Cl. ..... 164/97; 164/98; 164/529

[58] Field of Search ..... 164/529, 97, 98

[56] References Cited

U.S. PATENT DOCUMENTS

| | | | |
|---|---|---|---|
| 4,573,519 | 3/1986 | Donomoto et al. | 164/97 |

FOREIGN PATENT DOCUMENTS

| | | | |
|---|---|---|---|
| 388235 | 9/1990 | European Pat. Off. | 164/97 |
| 50-39406 | 12/1975 | Japan | 164/98 |
| 58-32564 | 2/1983 | Japan | 164/63 |
| 58-194779 | 11/1983 | Japan | 164/529 |
| 61-14061 | 1/1986 | Japan | 164/98 |
| 62-127158 | 6/1987 | Japan | 164/97 |
| 63-68239 | 3/1988 | Japan | 164/529 |
| 839649 | 7/1981 | U.S.S.R. | 164/529 |

*Primary Examiner*—Kuang Y. Lin
*Attorney, Agent, or Firm*—Ansel M. Schwartz

[57] ABSTRACT

The present invention is a process for forming net shape parts by matching mold and component CTE and having the mold heated near the liquidus such that the mold and the component go through the same thermal and dimensional changes during cool down of the component. The present invention also pertains to a method of producing the matched CTE mold. The method includes the step of providing the first material in porous form. Next, there is the step of melting the second material. Then, there is the step of infiltrating the first porous material with the second melted material in proportion such that their combined CTE essentially matches that of the composite component. The composite mold and composite component can be formed at the same time. In an alternative method for forming the mold having a specific CTE, there is the step of providing the first material and the second material. Next, there is the step of mixing the materials together in proportion such that the combined CTE essentially matches that of the component. Then, there is the step of pressing the materials together such that the mold is formed into the proper shape and has sufficient structure to form the component. The invention is also a system for casting. The system includes a mold having a specific CTE, means for containing a material. The component is comprised of heating means to melt the material and means to introduce the melted material into the mold.

5 Claims, 4 Drawing Sheets

MATCHED CTE CASTING FOR METAL MATRIX COMPOSITES

FIELD OF THE INVENTION

The present invention relates in general to a mold for casting. More specifically, the present invention relates to a mold for casting having a coefficient of thermal expansion essentially matching that of the component it is casting.

BACKGROUND OF THE INVENTION

It is known in the prior art to cast metal components in metal or graphite molds. The metal being cast solidifies as it hits the cold mold wall and shrinks away from the wall as it contracts. This makes the part easy to remove but requires that the mold be oversized to compensate for shrinkage of the metal as it cools.

A problem exists therein when a net shape metal component is needed having specific geometric tolerances. Since the metal shrinks away from the mold during cooling, in some parts more than others, the final geometric proportions of the cast component is difficult to predict.

Accordingly, there is a need in the art of metal casting for a mold which accurately forms a metal component; a mold wherein the geometric boundaries of metal component are essentially in contact with the mold wall at a variety of temperatures. In this manner, a net shape component can be produced within the exact dimensions of a mold at a given temperature. Further, such a mold will not create any undue stresses on the component due to contraction and expansion.

SUMMARY OF THE INVENTION

The present invention is a mold having a specific coefficient of thermal expansion (CTE). The mold is made of a first material having a CTE less than that of a component formed in the mold and a second material having a CTE greater than that of the component. The materials are integrally combined in proportion such that their combined (CTE) essentially matches that of the component.

The present invention also pertains to a method of producing the matched CTE mold. The method includes the step of providing the first material in porous form. Next, there is the step of melting the second material. Then, there is the step of infiltrating the first porous material with the second melted material in proportion such that their combined CTE essentially matches that of the component.

In an alternative method for forming the mold having a specific CTE, there is the step of providing the first material and the second material. Next, there is the step of mixing the materials together in proportion such that the combined CTE essentially matches that of the component. Then, there is the step of pressing the materials together such that the mold is formed into the proper shape and has sufficient structure to form the component.

The invention also pertains to a system for casting. The system includes a mold having a specific CTE, means for containing a material fluidically connected to the mold casting, heating means to melt the material and means to introduce the melted material into the mold.

The present invention also pertains to a method of casting. The method comprises the steps of providing a porous mold defining a mold cavity. The mold cavity has a porous reinforcement material disposed within the mold. The reinforcement material and the porous mold have essentially the same coefficient of thermal expansion. Then, there is the step of heating the mold and the reinforcement material. Next, there is the step of infiltrating the mold and the reinforcement material with a melted material. Then, there is the cooling the mold and the reinforcement material such that the melted material solidifies. Next, there is the step of removing the infiltrated mold from the infiltrated reinforcement material.

BRIEF DESCRIPTION OF THE DRAWINGS

In the accompanying drawings, the preferred embodiment of the invention and preferred methods of practicing the invention are illustrated in which.

DESCRIPTION OF THE PREFERRED EMBODIMENT

Figure 1:
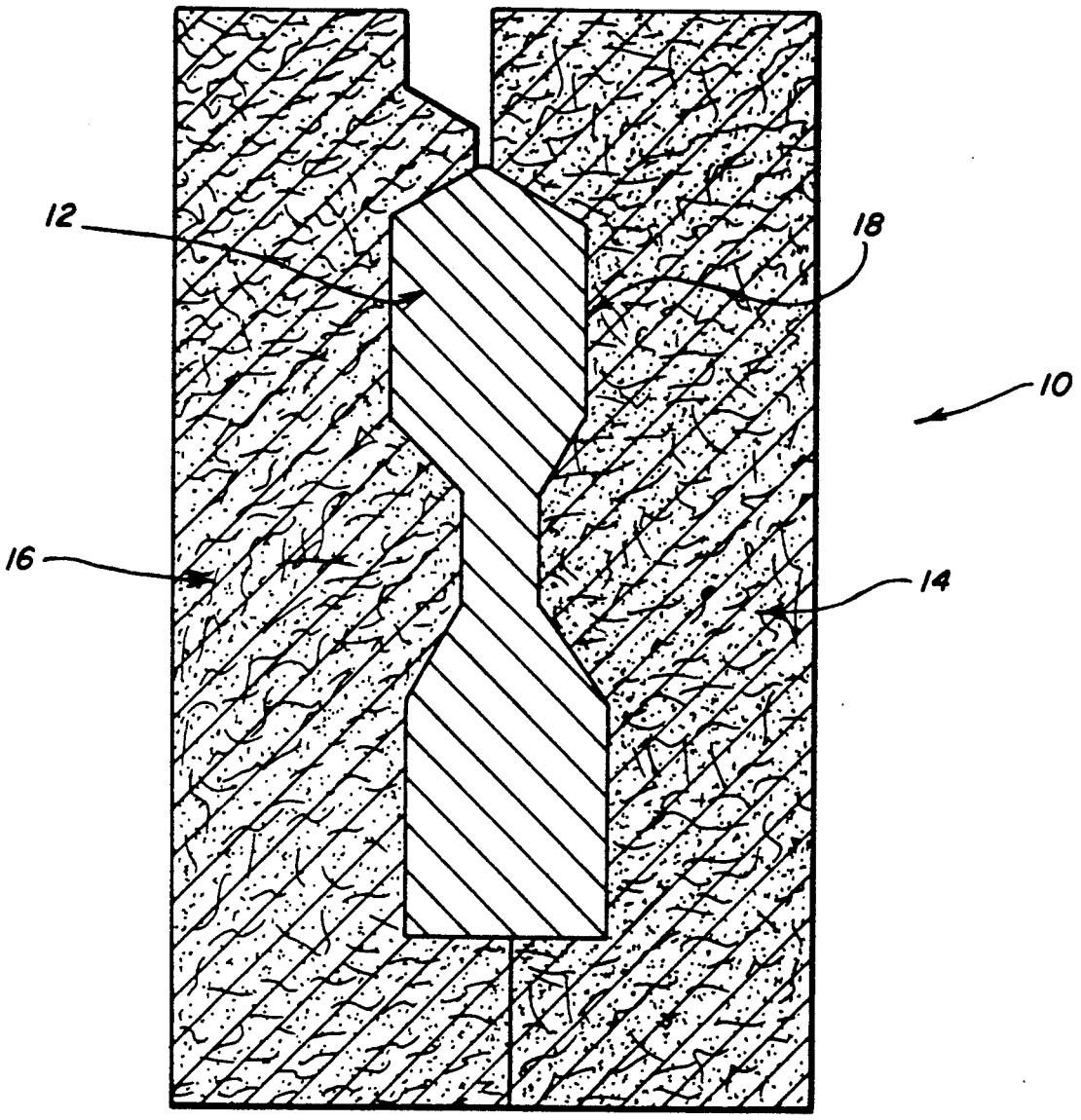
FIG. 1 is a cross section schematic view of the mold.

Referring now to the drawings wherein like reference numerals refer to similar or identical parts throughout the several views, and more specifically to FIG. 1 thereof, there is shown a cross sectional schematic view of a mold 10 for forming a component 12 having a specific coefficient of thermal expansion (CTE). The mold 10 is comprised of a first material 14 having a CTE less than that of the component 12 and a second material 16 having a CTE greater than that of the component 12. The first and second materials 14, 16 are integrally combined in proportion such that their combined CTE essentially matches that of the component 12. Preferably, the component 12 to be formed is made of metal. Further, the component 12 is preferably comprised of a metal matrix composite such as one comprised of aluminum and silicon carbide (SiC) particles which is well known in the art.

As an example, a component 12 having a 65% volume fraction of SiC is infiltrated with aluminum. The resulting CTE of their combination is 8.5. Accordingly, it is necessary to have a mold with a CTE of 8.5. By taking graphite with a CTE of 4 and 6% open porosity and infiltrating it with copper with a CTE of 13, a mold 10 can be produced having a CTE of 8.5. Thus, the mold 10 can contract and expand with the part during the casting process. This is accomplished by taking the mold to a high temperature near the melting point of the metal to be cast so that the matched CTE mold can be cooled down along with the part so that they undergo the same dimensional changes. Accordingly, shrinkage and undue stresses can be avoided. Further, by using copper or another metal having a higher melting temperature than that of aluminum, a high quality mold surface is produced.

Alternatively, by infiltrating different ceramics having various porosities with different metals, a mold 10 can be formed which matches the CTE of the component. For example, to make a mold 10 for a SiC-/aluminum component which has a volume fraction of 60% SiC to 40% aluminum, SiC can be infiltrated with copper to produce a high temperature, nonporous mold 10 that has a volume fraction of 50% SiC to 50% copper which essentially matches the CTE of the 60% volume fraction SiC/aluminum component.

It should be noted that a variety of different materials can be combined to form molds having a variety of CTEs. The first material 14 can be comprised of ceramic, graphite, SiC, boron carbide, silica and the like. The second material can be comprised of aluminum, copper, silver and stainless steel, to name but a few. Different ceramics, or carbon forms can also be molded or sintered together to produce a desired CTE mold material.

The invention also relates to a method of producing a mold 10 having a specific CTE. The method comprises the step of providing a first porous material having a CTE less than that of a component formed within the mold. Then, there is the step of melting a second material having a CTE greater than that of the component. Next, there is the step of infiltrating the first porous material with the second melted metal such that their combined CTE essentially matches that of the component and the structure of the mold is formed.

In an alternative method, to form a mold 10 having a specific CTE, there is the first step of providing a first material having a CTE less than that of a component formed within the mold. Then, there is the step of providing a second material having a coefficient of thermal expansion greater than that of the component. Next, there is the step of mixing the first and second material together in proportion such that their combined coefficient of thermal expansion essentially matches that of the component. Finally, there is the step of pressing the mixture of the first and second materials together such that the mold 10 is formed into the proper shape and has sufficient structure to form the component. The pressing step can take place in any suitable pressing apparatus such as a hydraulic press, a hot isostatic press or a cold isostatic press. Preferably, the component produced in the mold 10 formed by the previously described method is comprised of metal. More preferably, the component is comprised of a metal matrix composite.

As an example, when forming a component comprised of metal, the first material can be comprised of a ceramic such as silica carbide or glass or quartz and the second material can be comprised of a salt. Ceramic material can also be fused together by sintering.

The invention also relates to a method of casting. The method comprises the step of providing a mold 10 for forming a component 12. The mold 10 has a CTE that essentially matches that of the component 12. Next, there is the step of melting a material of which the component 12 is comprised. Then, there is the step of introducing the melted material that the component 12 is comprised of into the mold 10 to form the component 12. Then, there is the step of heating the mold near the melting point of the metal to be cast. Next, there is the step of cooling the mold 10 such that the component 12 solidifies, causing the mold and component to go through the same dimensional changes. Finally, there is the step of removing the component 12 from the mold 10. Preferably, before the introducing step, there is the step of heating the mold.

Preferably, the mold 10 is comprised of a first material having a CTE less than that of the component 12 which is integrally combined in proportion with a second material having a CTE greater than that of the component 12 such that the materials in combination essentially match the CTE of the component.

In an alternative method for casting, a porous mold is infiltrated with melted material as well as the preform it encases. This method comprises the first step of providing a porous mold defining a mold cavity. The mold cavity has a preform disposed within. The mold and the preform have essentially the same coefficient of thermal expansion. Then, there is the step of heating the mold and the porous preform. During the heating step, since the mold and the preform have the same CTE, they expand together. In this manner, the mold does not create any undue stresses on the preform during heating. Next, there is the step of infiltrating both the mold and the preform with melted material. Then, there is the step of cooling the mold and the preform such that the melted material solidifies. Since the preform and mold have been infiltrated with the same melted material, their CTEs are still essentially the same, and thus, during cooling, they shrink at the same rate. Finally, there is the step of removing the infiltrated preform from the infiltrated mold.

As an example, a ceramic preform might have a CTE of 2 before infiltration and a CTE of 10 after infiltration. This method allows the mold CTE to vary such that it matches the CTE of the preform during heating and cooling. Thus, it is possible to infiltrate preforms which fit exactly in the mold without the mold causing the preform to disform.

Since the CTEs of the component and mold are matched, they can expand and contract in unison. Accordingly, the surface of the component 12 is essentially in constant contact with the mold 10 during the casting process. This will not create any stress on the component 12. Further, the overall size of the component 12, at room temperature, will be the exact size of the mold cavity at room temperature. This allows for extremely accurate tolerancing and very fine detail of the component 12. Thus, no oversizing of the mold is required as with all other casting systems which require many calculation and iterations of mold to get a desired dimension.

Figure 2:
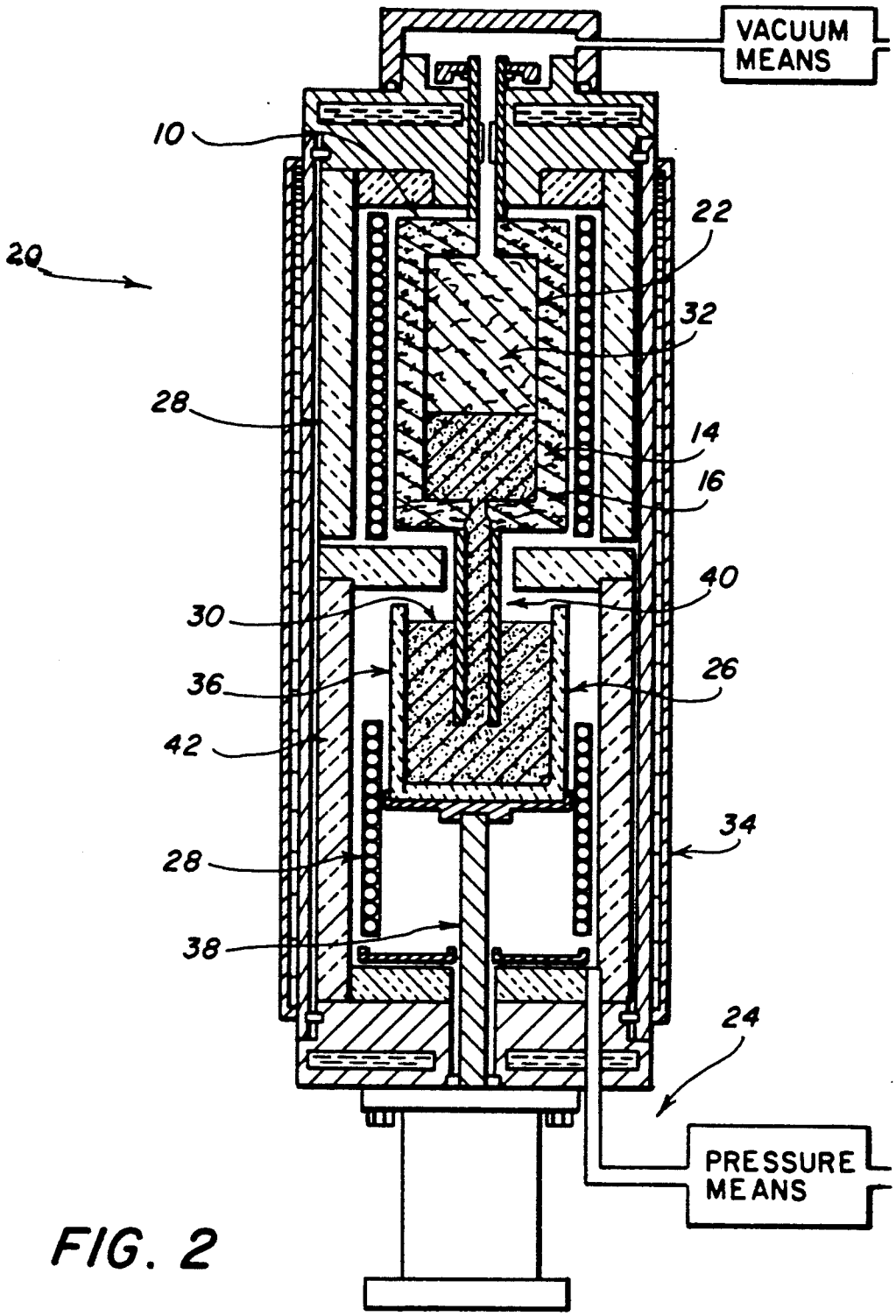
FIG. 2 is a cross section schematic view of a preferred embodiment of the system for casting within the mold.

As shown in FIG. 2, the invention also relates to a system 20 for casting. The system 20 comprises a mold 10 defining a mold cavity 22 for forming a component 12. The mold 10 has a CTE essentially matching that of the component 12. The system 10 further includes means 26 for containing the material 30 which is fluidically connected to the mold cavity 22. There is also means 24 for introducing a material 30 into the mold cavity 22. The introducing means 24 is fluidically connected to the containing means 26. There is also included means 28 for heating the material such that the material 30 is melted in the containing means 26 and stays melted as it is introduced into the mold cavity 22 by the introducing means 24. The heating means 28 is disposed adjacent to the containing means 26. Preferably, the heating means 28 is also in thermal communication with the mold 10. In a preferred embodiment, the mold 10 is comprised of a first material 14 which has a CTE less than that of the component which is integrally combined in proportion with a second material 16 having a CTE greater than that of the component such that the materials 14, 16 in combination essentially match the CTE of the component 12.

In a more preferred embodiment, the component is comprised of a metal matrix composite and a porous preform 32 comprised of a material such as SiC is situated in the mold 10. The material 30 in the containing means 26 is aluminum. There is included a pressure vessel 34, means for evacuating the pressure vessel 34 and means for pressurizing the pressure vessel 34. The containing means 26 is comprised of a crucible 36 which is attached to a lift system 38 for raising the crucible 36 such that the aluminum is selectively fluidically connected to a passage 40 which feeds into the mold cavity 22. The heating means 28 is comprised of a heating element which surrounds the crucible 36 and the mold 10. The evacuating means is fluidically attached to the mold cavity 22 from the top. Insulation 42 surrounds the inside of the pressure vessel 34. The system 10 operates by evacuating the vessel with the lift system 38 down, melting the aluminum in the crucible 36, raising the crucible with the lift system such that the melted aluminum fluidically contacts the passage 40 and pressurizing the vessel such that the aluminum is forced into the mold cavity 22 of the mold 10 to infiltrate the preform 32.

Figure 3:
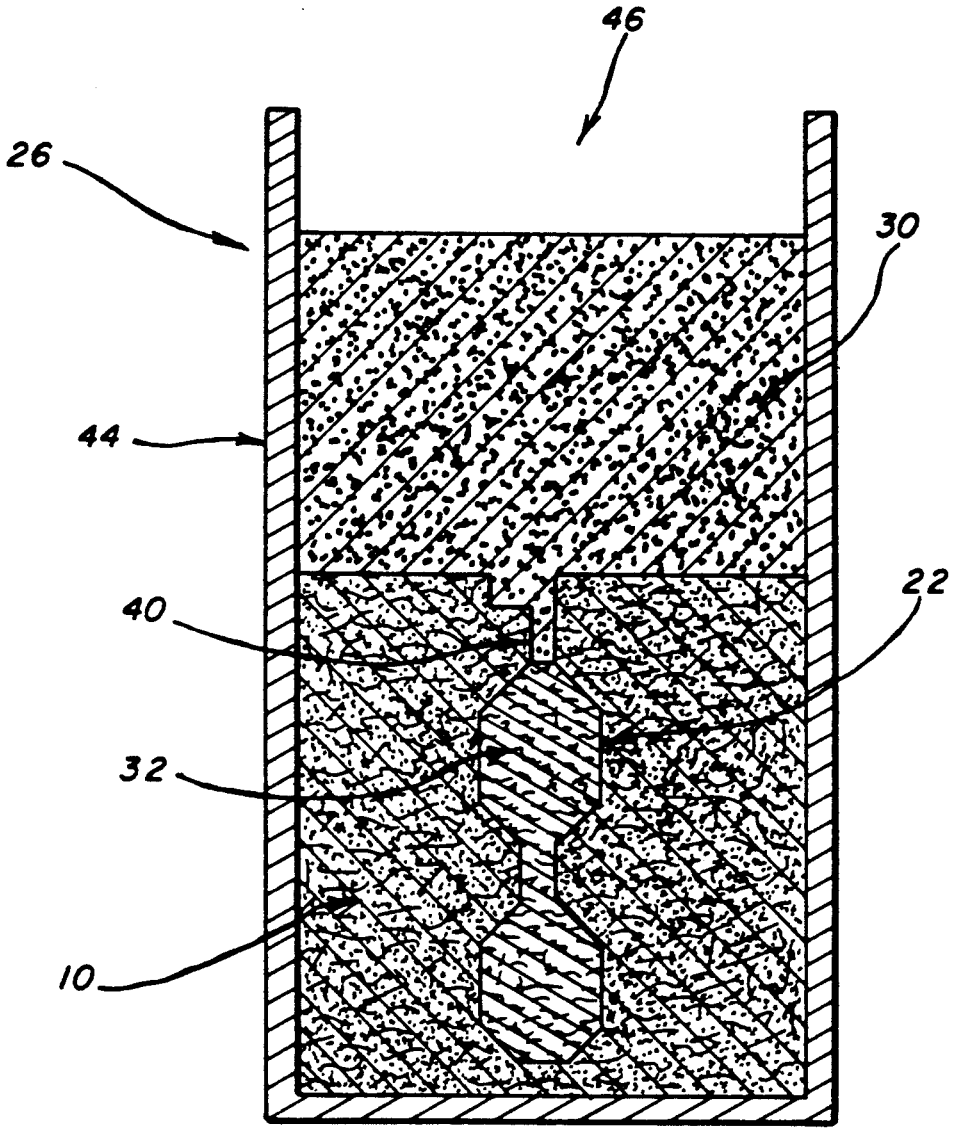
FIG. 3 is a cross section schematic view of the material above the mold within a can.

In an alternative embodiment, and as shown in FIG. 3, the containing means 26 comprises a can 44 having an open end 46. The mold having the passage 40 formed within, is disposed within the can 44, towards the bottom. The material 30 is situated above the mold 10. Preferably, a porous preform 32 is disposed within the mold 10. In this embodiment, the can is evacuated to remove any gas from within. The material 30 is then melted to seal the open end 46 of the can 44. The sealed can 44 is then pressurized to force the material 30 into the mold cavity 22.

Figure 4:
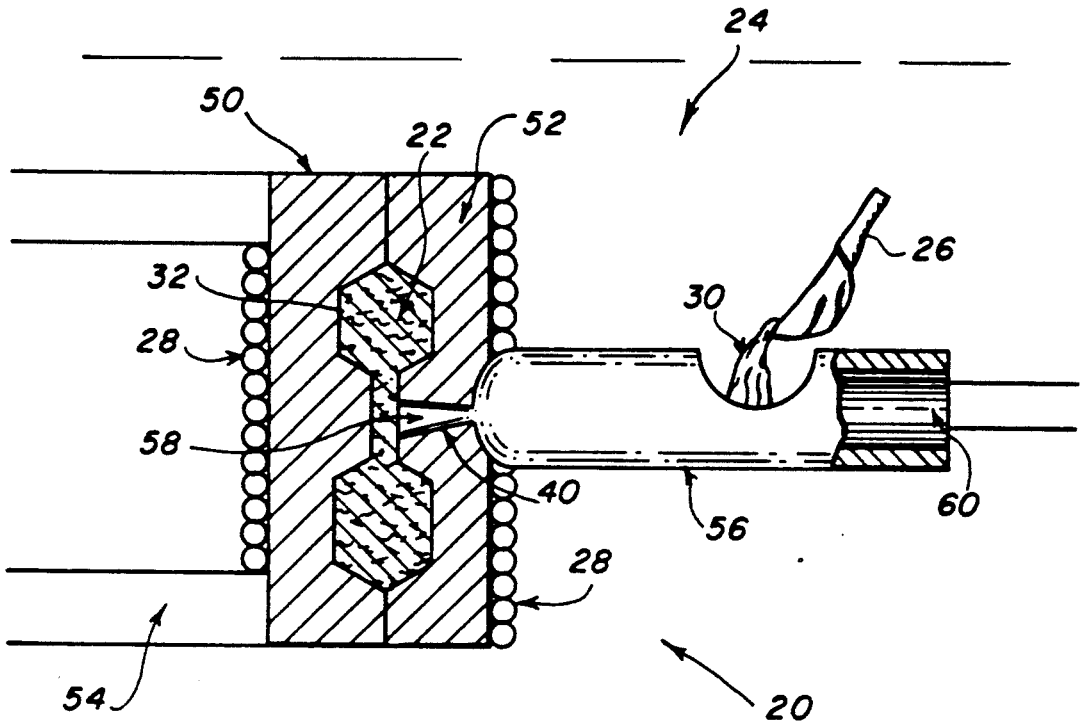
FIG. 4 is a cross section schematic view of a preferred embodiment of the system for casting within the mold.

In an alternative embodiment, and as shown in FIG. 4, the system 20 is adapted for die casting. The mold is comprised of separable mold halves 50, 52 which are separated and held together in a sealed relationship with a pressing apparatus 54. The introducing means 24 includes an injection system 56 fluidically connected to the mold cavity 22 through a port 58. The heating means 28 surround the separable mold halves 50, 52 to provide heating. Preferably, the injection system 56 includes a hydraulic ram 60 for forcing the melted material 30 through the port 58 and into the mold cavity 22. The arrangement and operation of these elements is well known in the art of die casting.

In the operation of the mold 10, the preform 32 is comprised of silicon carbide particles having a 65% volume fraction which, when infiltrated with aluminum, will have an overall CTE of 8.5. To form a mold 10 having a CTE of 8.5, copper having a CTE of 13 is infiltrated into graphite having a 10% open porosity and a CTE of 7.

During casting, the preform 32 is situated in the mold 10, and the mold 10 and preform 32 are then heated to the melting point of aluminum. Note that the melting point of copper is higher than that of aluminum s the mold will not melt. Melted aluminum is then forced into the mold 10 to infiltrate the preform 32 and to fill the mold cavity 32. At this point, the preform 32 and aluminum which make up the component 12 are essentially in thermal equilibrium with the mold 10 (i.e. same temperature). The component 12 is solidified by cooling the mold 10. Since the CTE of the component and mold are matched, they will react as a single thermal mass, contracting in unison without any discontinuities. In this manner, the surface of the component 12 is always in contact with the mold 10 and the final shape of the component at room temperature is very predictable since it will be exactly the shape of the mold cavity at room temperature. Once cool, the component can be removed from the mold.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A method of producing a mold having a specific coefficient of thermal expansion comprising the steps of:

determining the coefficient of thermal expansion of a component to be formed in the mold;

providing a first porous material having a coefficient of thermal expansion less than that of the component formed within said mold;

shaping the first porous material to form said mold;

melting a second material having a coefficient of thermal expansion greater than that of the component; and infiltrating said mold with the second melted material in proportion such that their combined coefficient of thermal expansion essentially matches that of the component.

2. A method as described in claim 1 wherein the first material is comprised of a ceramic and the second material is comprised of a metal.

3. A method as described in claim 1 wherein the first material is comprised of graphite and the second material is comprised of a metal.

4. A method of casting comprising the steps of:

providing a porous mold defining a mold cavity, said mold cavity having a porous preform disposed within said mold, said preform and said porous mold having essentially the same coefficient of thermal expansion;

heating said mold and said preform;

infiltrating said mold and said preform with a melted material;

cooling said mold and said preform such that the melted material solidifies; and removing the infiltrated mold from the infiltrated preform.

5. A method of casting comprising the steps of:

providing a porous mold defining a mold cavity, said mold cavity having a porous reinforcement material disposed within said mold, said reinforcement material and said porous mold having essentially the same coefficient of thermal expansion;

heating said mold and said reinforcement material;

infiltrating said mold and said reinforcement material with a melted material;

cooling said mold and said reinforcement material such that the melted material solidifies; and removing the infiltrated mold from the infiltrated reinforcement material.

* * * * *